US006771787B1

(12) United States Patent
Hoefler et al.

(10) Patent No.: US 6,771,787 B1
(45) Date of Patent: Aug. 3, 2004

(54) WAVEGUIDE ELECTROACOUSTICAL TRANSDUCING

(75) Inventors: Jeffrey Hoefler, Randolph, MA (US); John H. Wendell, Reading, MA (US); Robert P. Parker, Westboro, MA (US); Thomas A. Froeschle, Southboro, MA (US); William P. Schreiber, Ashland, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 09/146,662

(22) Filed: Sep. 3, 1998

(51) Int. Cl.[7] ..... H04R 25/00

(52) U.S. Cl. ..... 381/338; 381/337; 381/94.1; 381/340; 381/345; 381/351; 381/64; 181/152; 181/149; 181/156; 181/145; 367/188

(58) Field of Search ..... 381/337, 338, 381/339, 335, 336, 99, 98, 94.1, 345–353, 64, 340, 115; 181/148, 151, 153, 152, 145, 156; 367/188, 137

(56) References Cited

U.S. PATENT DOCUMENTS 3,768,589 A * 10/1973 Nilsson
4,628,528 A * 12/1986 Bose
4,930,596 A * 6/1990 Saiki et al.
5,105,905 A * 4/1992 Rice
5,373,564 A * 12/1994 Spear
5,832,099 A * 11/1998 Wiener ..... 381/386
6,002,781 A * 12/1999 Takayama et al. ..... 381/338

FOREIGN PATENT DOCUMENTS

| | | |
|---|---|---|
| FR | 1 359 616 A | 8/1964 |
| FR | 2 653 630 A | 4/1991 |
| WO | 96 11558 A | 4/1996 |
| WO | 98 20659 A | 5/1998 |

* cited by examiner

*Primary Examiner*—Curtis Kuntz
*Assistant Examiner*—Dionne Harvey
(74) *Attorney, Agent, or Firm*—Fish & Richardson P.C.

(57) ABSTRACT

A waveguide system for radiating sound waves. The system includes a low loss waveguide for transmitting sound waves, having walls are tapered so that said crosssectional area of the exit end is less than the cross-sectional area of the inlet end. In a second aspect of the invention, a waveguide for radiating sound waves, has segments of length approximately equal to $$A(y) = A_{inlet}\left[1 - 2\frac{Y}{B} + \left(\frac{Y}{B}\right)^2\right]$$

where l is the effective length of said waveguide and n is a positive integer. The product of a first set of alternating segments is greater than the product of a second set of alternating segments, in one embodiment, by a factor of three. In a third aspect of the invention, the first two aspects are combined.

32 Claims, 18 Drawing Sheets

WAVEGUIDE ELECTROACOUSTICAL TRANSDUCING

The invention relates to acoustic waveguide loudspeaker systems, and more particularly to those with waveguides which have nonuniform cross-sectional areas. For background, reference is made to U.S. Pat. No. 4,628,528 and to U.S. patent application Ser. No. 08/058478, entitled "Frequency Selective Acoustic Waveguide Damping" filed May 5, 1993, incorporated herein by reference.

It is an important object of the invention to provide an improved waveguide.

According to the invention, a waveguide loudspeaker system for radiating sound waves includes a low loss waveguide for transmitting sound waves. The waveguide includes a first terminus coupled to a loudspeaker driver, a second terminus adapted to radiate the sound waves to the external environment, a centerline running the length of the waveguide, and walls enclosing cross-sectional areas in planes perpendicular to the centerline. The walls are tapered such that the cross-sectional area of the second terminus is less than the cross-sectional area of the first terminus.

In another aspect of the invention, a waveguide loudspeaker system for radiating sound waves includes a low loss waveguide for transmitting sound waves. The waveguide includes a first terminus coupled to a loudspeaker driver, a second terminus adapted to radiate the sound waves to the external environment, a centerline, walls enclosing cross-sectional areas in planes perpendicular to the centerline, and a plurality of sections along the length of the centerline. Each of the sections has a first end and a second end, the first end nearer the first terminus than the second terminus and the second end nearer the second terminus than the first terminus, each of the sections having an average cross-sectional area. A first of the plurality of sections and a second of the plurality of sections are constructed and arranged such that there is a mating of the second end of the first section to the first end of the second section. The cross-sectional area of the second end of the first section has a substantially different cross-sectional area than the first end of the second section.

In still another aspect of the invention, a waveguide loudspeaker system for radiating sound waves includes a low loss waveguide for transmitting sound waves. The waveguide includes a first terminus coupled to a loudspeaker driver, a second terminus adapted to radiate the sound waves to the external environment, a centerline, running the length of the waveguide, walls enclosing cross-sectional areas in planes perpendicular to the centerline, and a plurality of sections along the length of the centerline. Each of the sections has a first end and a second end, the first end nearer the first terminus and the second end nearer the second terminus. A first of the plurality of sections and a second of the plurality of sections are constructed and arranged such that there is a mating of the second end of the first section to the first end of the second section. The cross-sectional area of the first section increases from the first end to the second end according to a first exponential function and the cross-sectional area of the second end of the first section is larger than the cross-sectional area of the first end of the second section.

In still another aspect of the invention, a waveguide loudspeaker system for radiating sound waves includes a low loss waveguide for transmitting sound waves. The waveguide has a tuning frequency which has a corresponding tuning wavelength. The waveguide includes a centerline, running the length of the waveguide, walls enclosing cross-sectional areas in planes perpendicular to the centerline, and a plurality of sections along the centerline. Each of the sections has a length of approximately one fourth of the tuning wavelength, and each of the sections has an average cross-sectional area. The average cross-sectional area of a first of the plurality of sections is different than the average cross-sectional area of an adjacent one of the plurality of sections.

In still another aspect of the invention, a waveguide for radiating sound waves has segments of length approximately equal to $$A(y) = A_{inlet}\left[1 - 2\frac{Y}{B} + \left(\frac{Y}{B}\right)^2\right]$$

where l effective length of the waveguide and n is a positive integer. Each of the segments has an average cross-sectional area. A product of the average cross-sectional areas of a first set of alternating segments is greater than two times a product of the average cross-sectional areas of a second set of alternating segments.

Other features, objects, and advantages will become apparent from the following detailed description, which refers to the following drawings in which.

Figure 4:
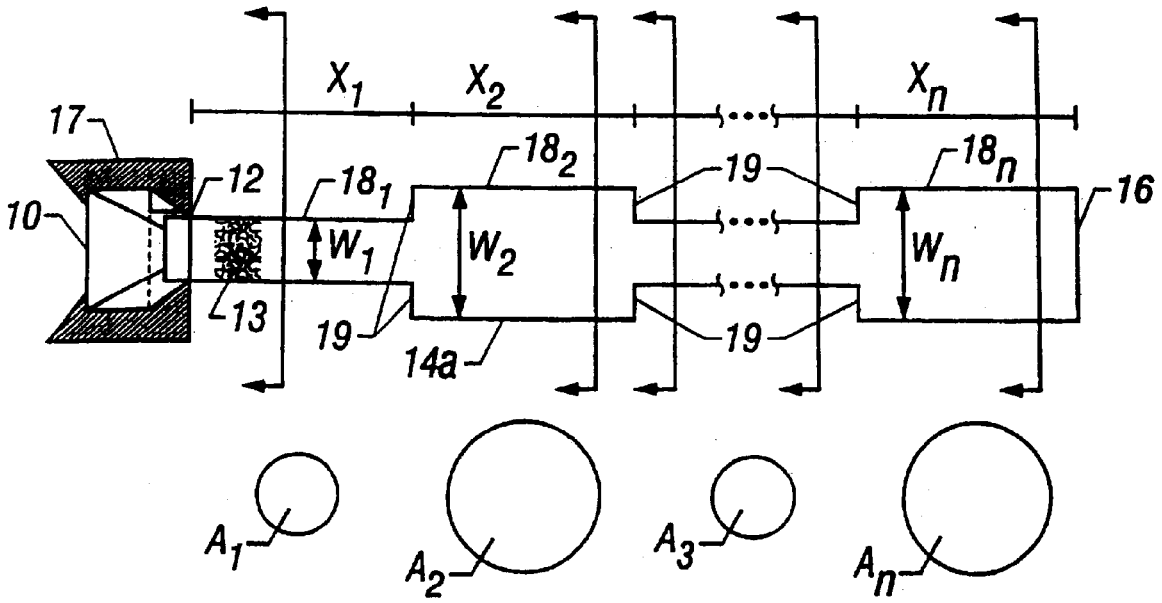
FIG. 4 is a cross-sectional view of a waveguide according to a second aspect of the invention.
Figure 5A:
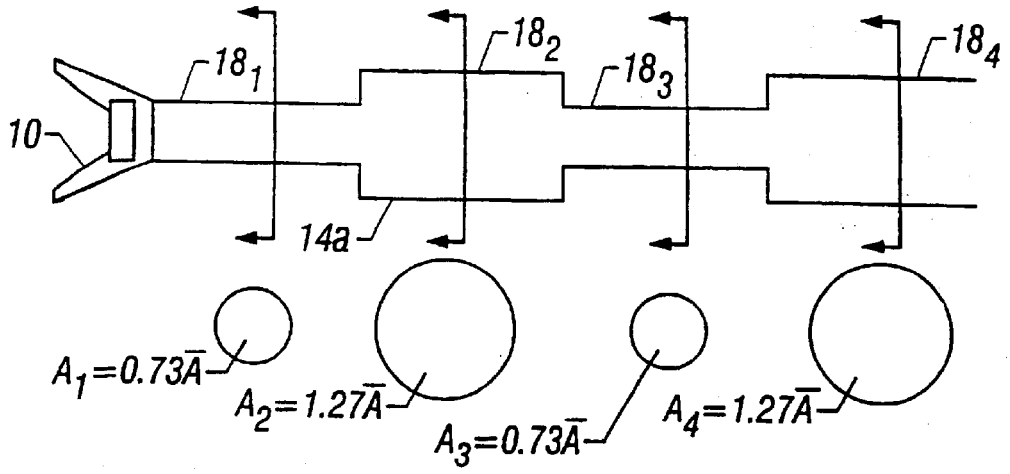
Figure 6A:
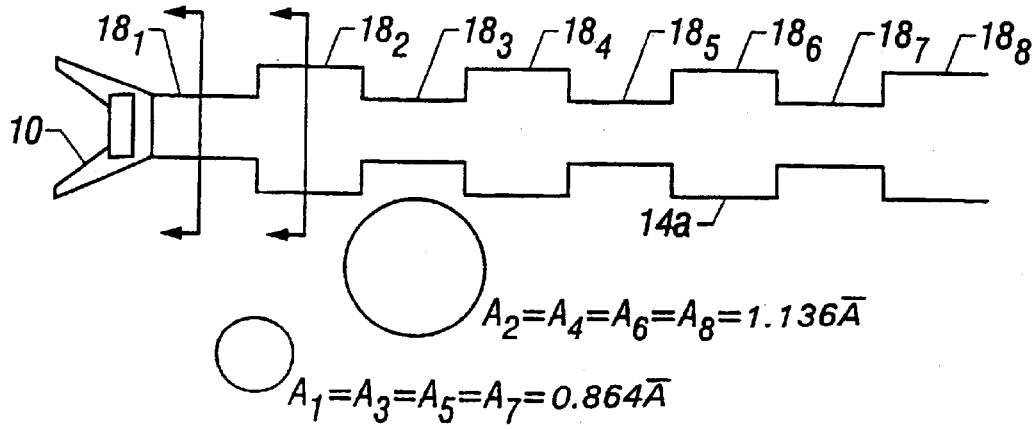
Figure 7A:
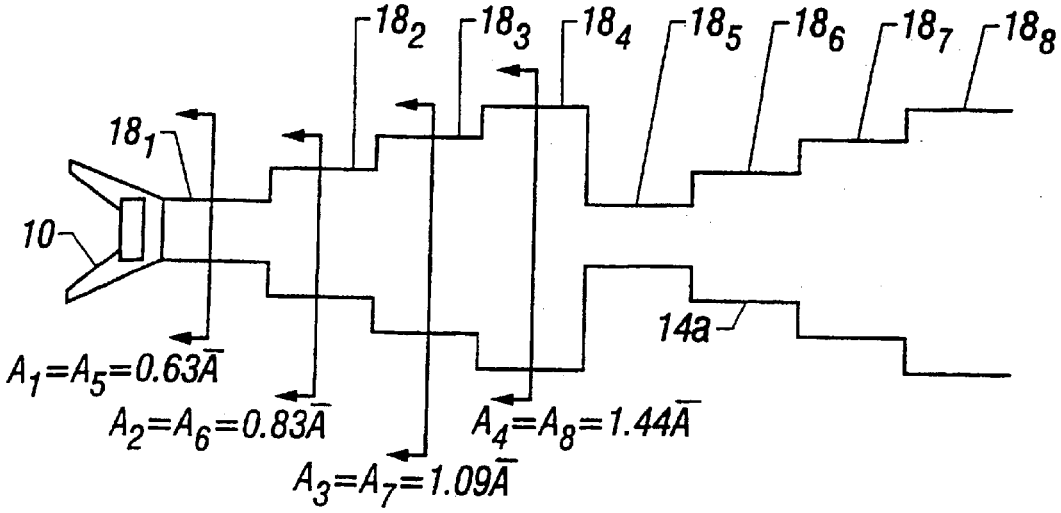

FIGS. 5*a* and 6*a* are cross-sectional views of variations of the waveguide of FIG. 4;

FIG. 7*a* is a cross-sectional view of a superposition of the waveguide of FIG. 6*a* on the waveguide of FIG. 5*a;*

Figure 1:
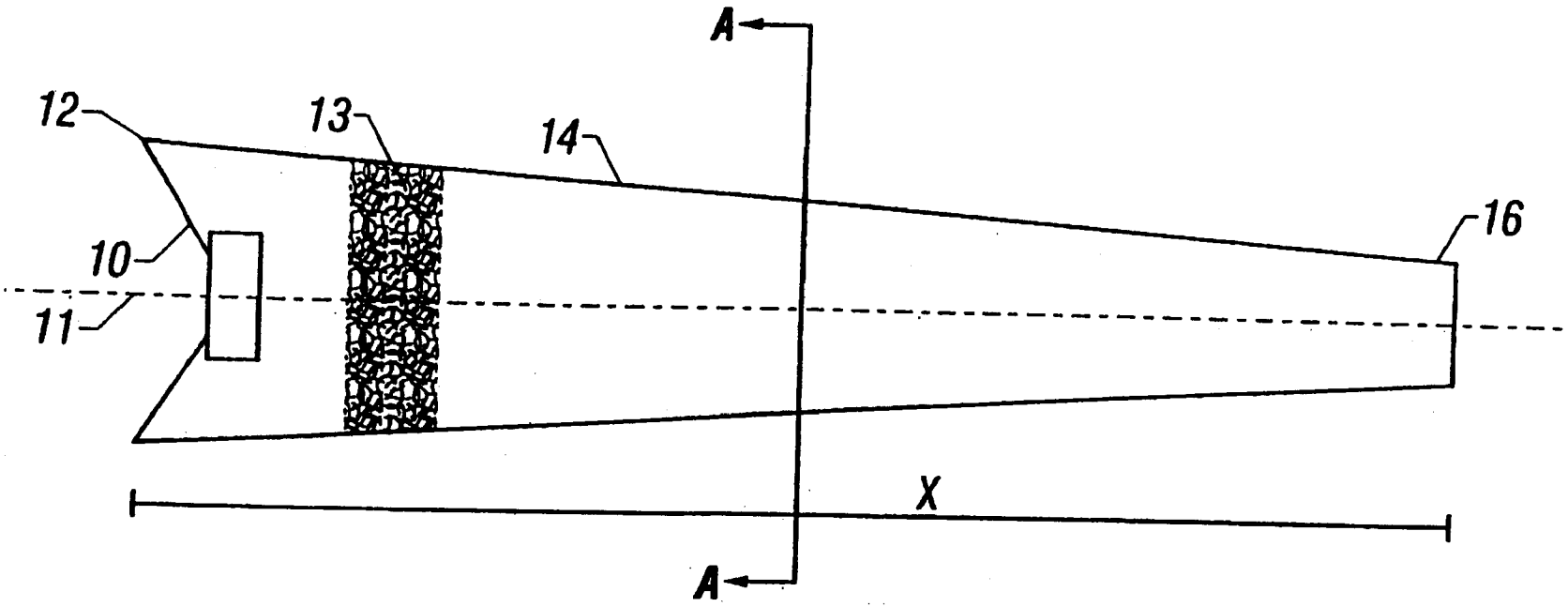
FIG. 1 is a cross-sectional view of a waveguide loudspeaker system according to the invention.
Figure 8:
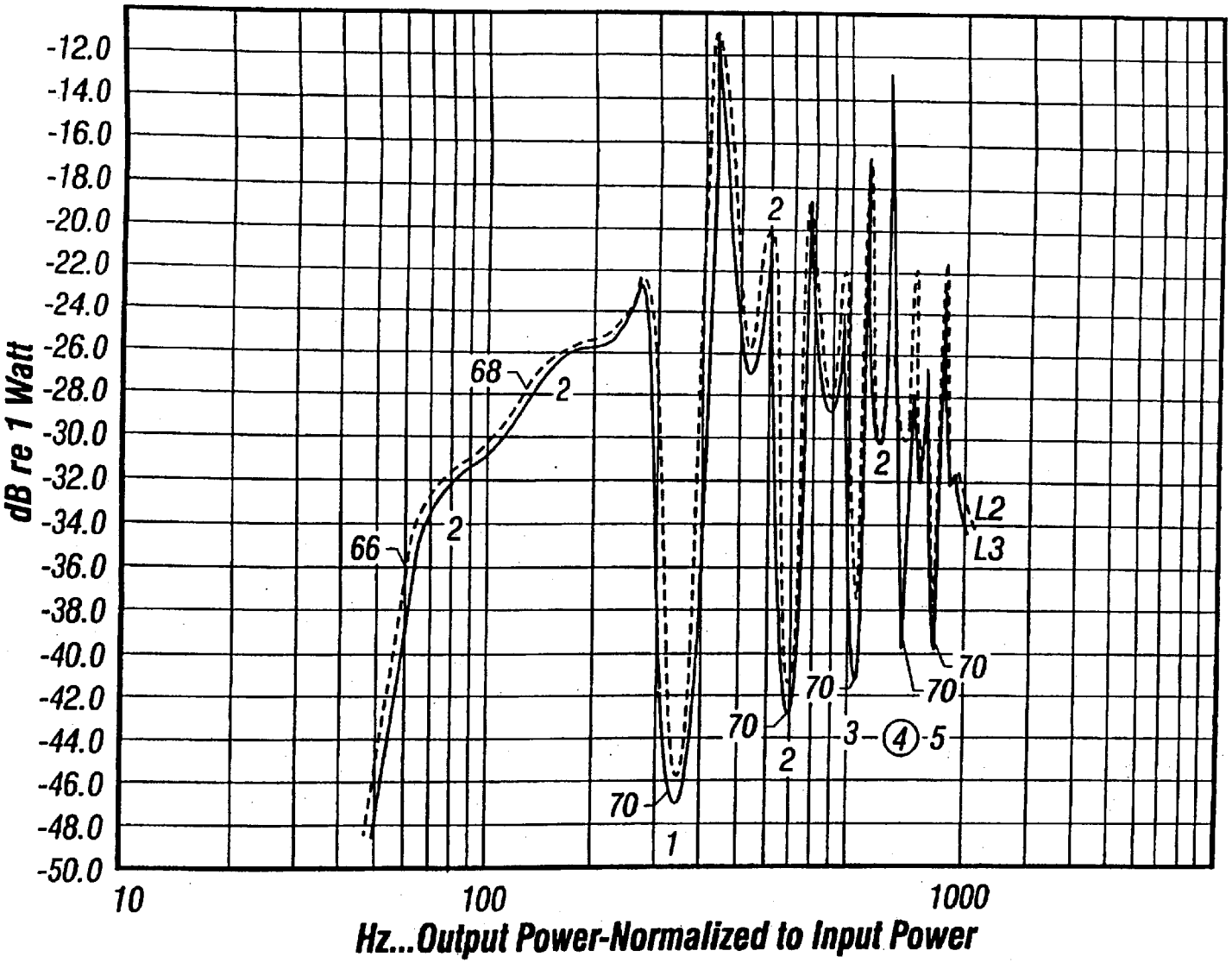
Figure 9:
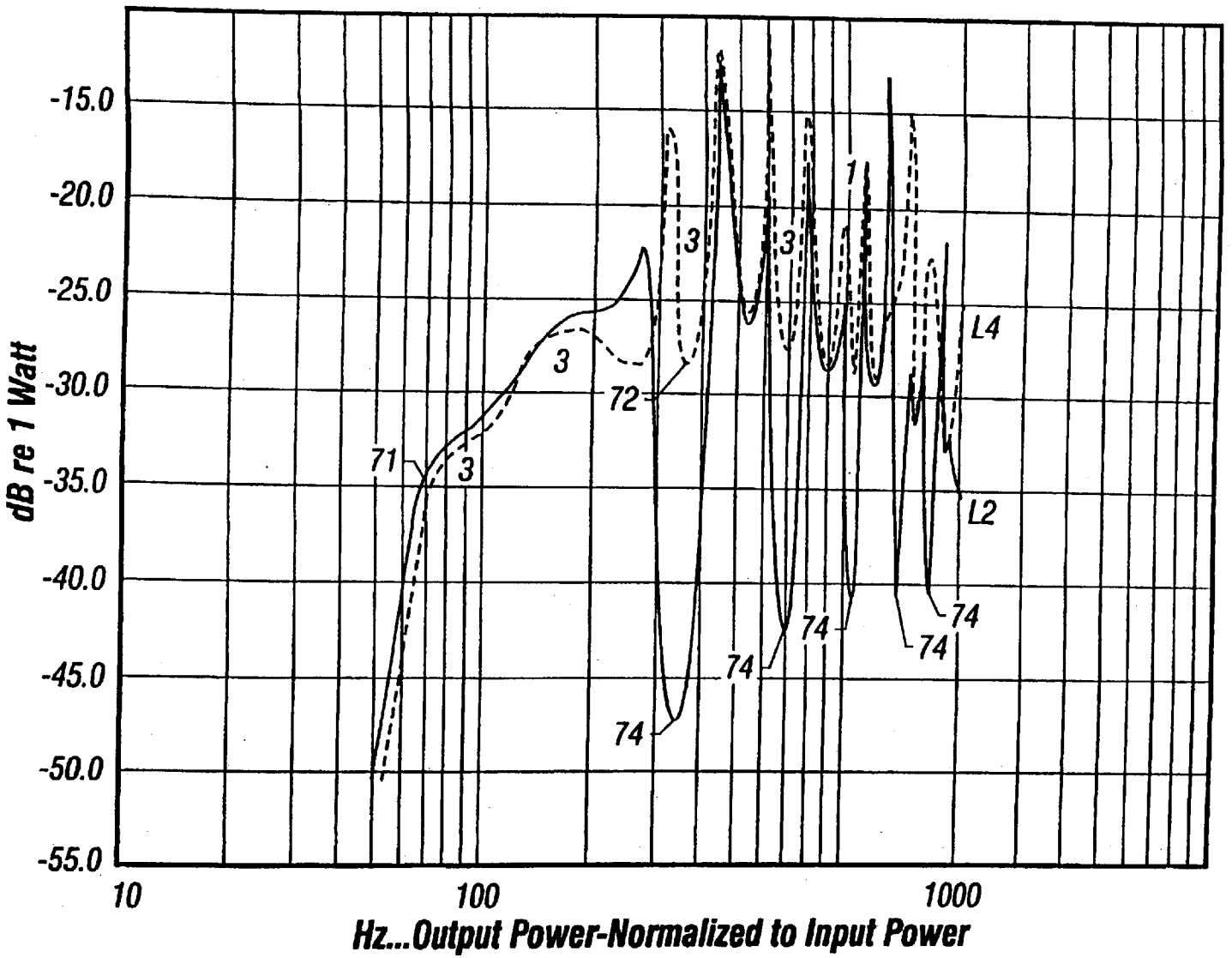
Figure 10:
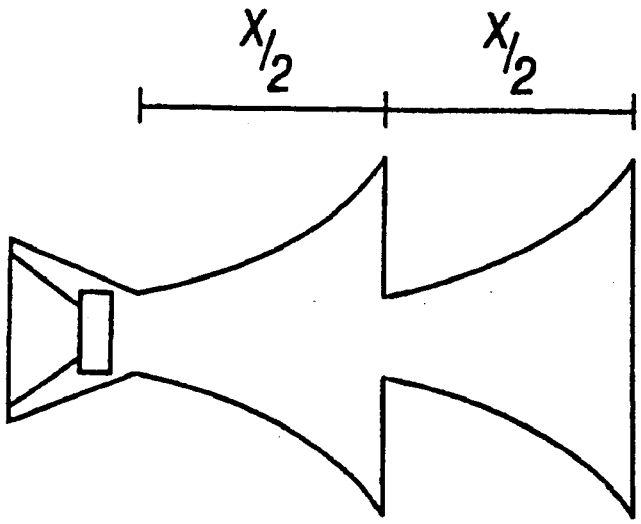
Figure 11:
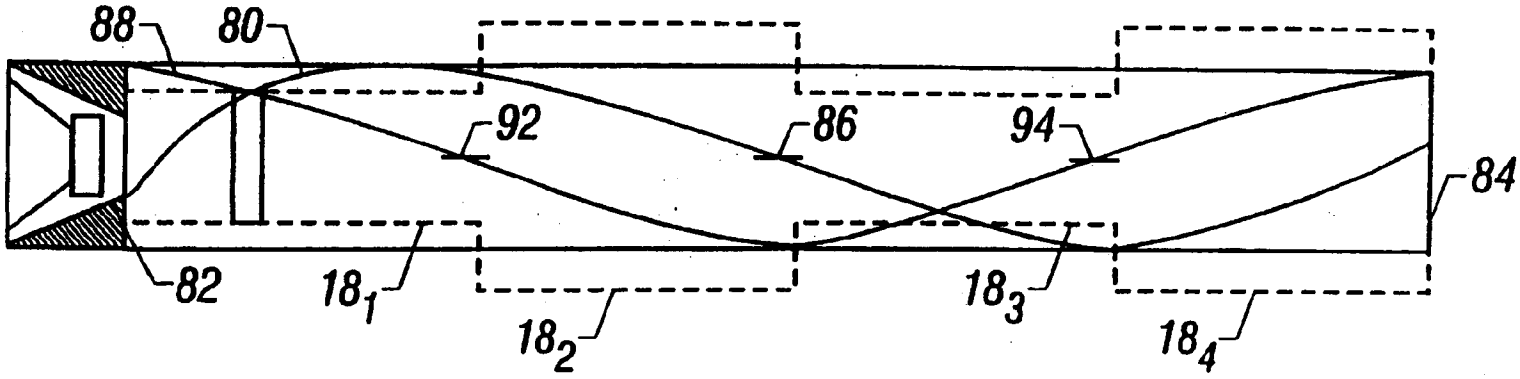
Figure 12A:
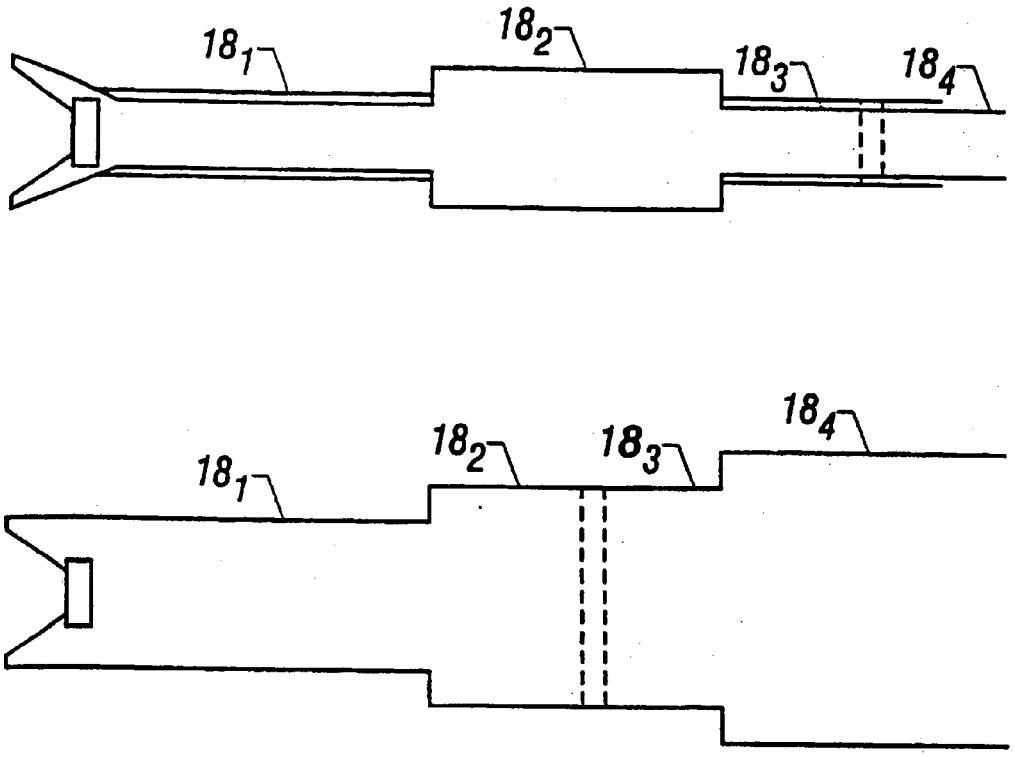
Figure 12B:
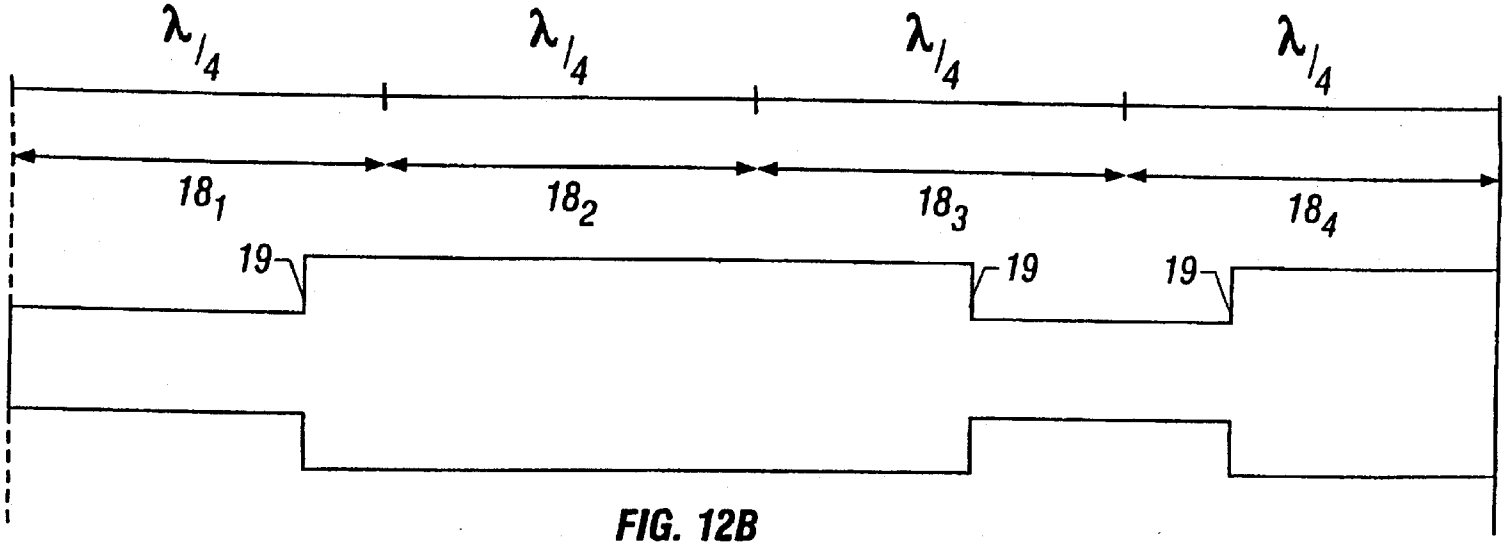
Figure 12C:
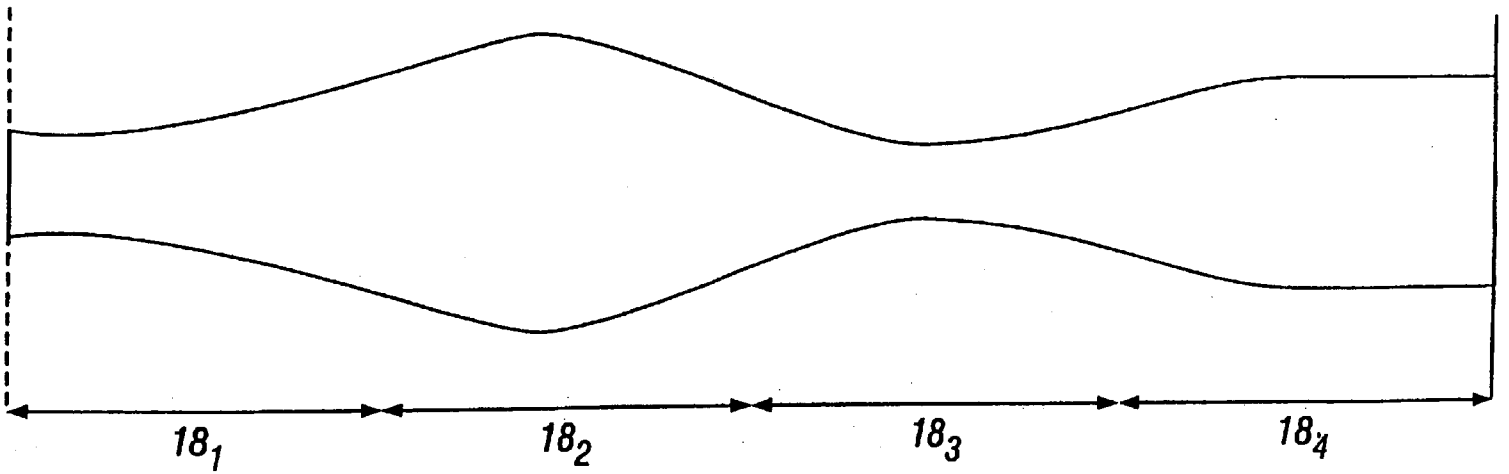
Figure 13:
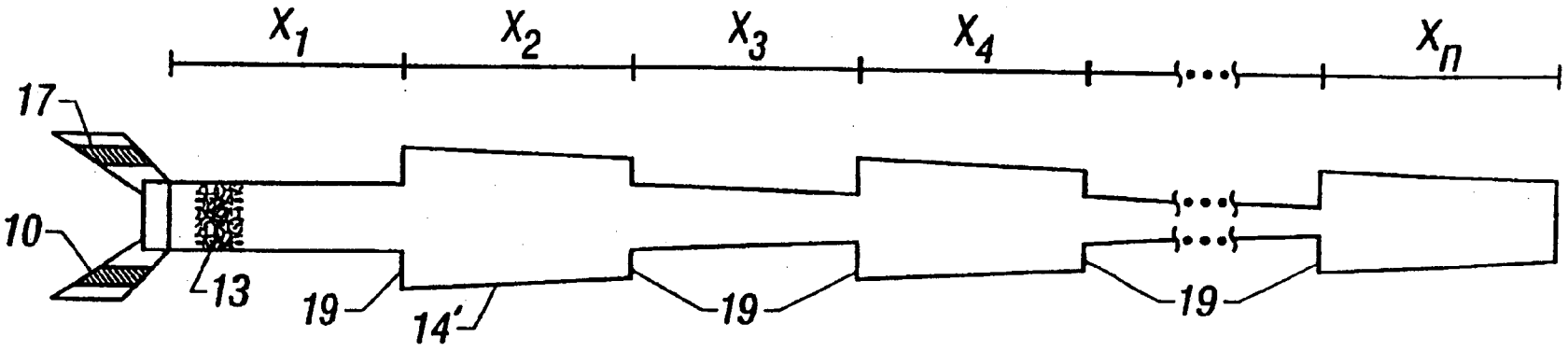
Figure 14A:
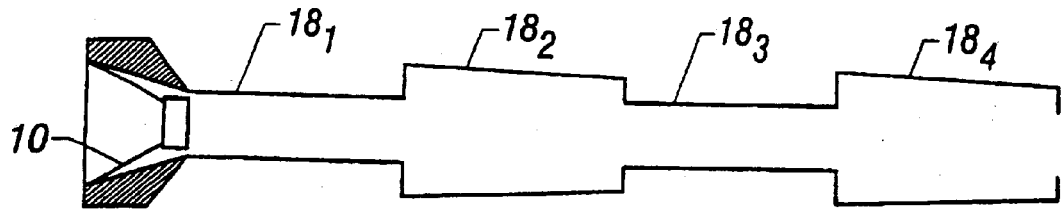
Figure 14B:
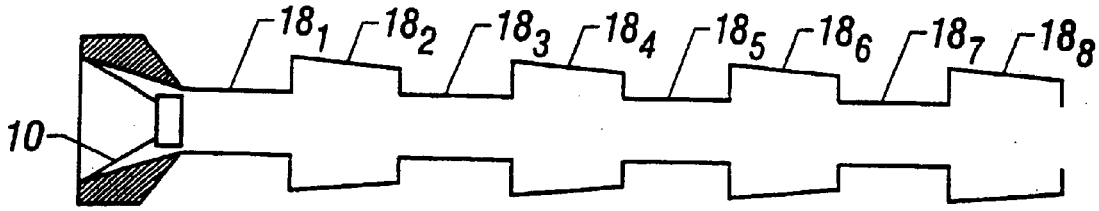
Figure 14C:
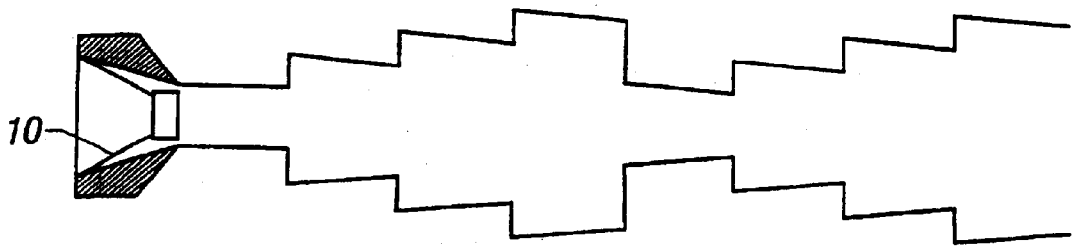
Figure 15A:
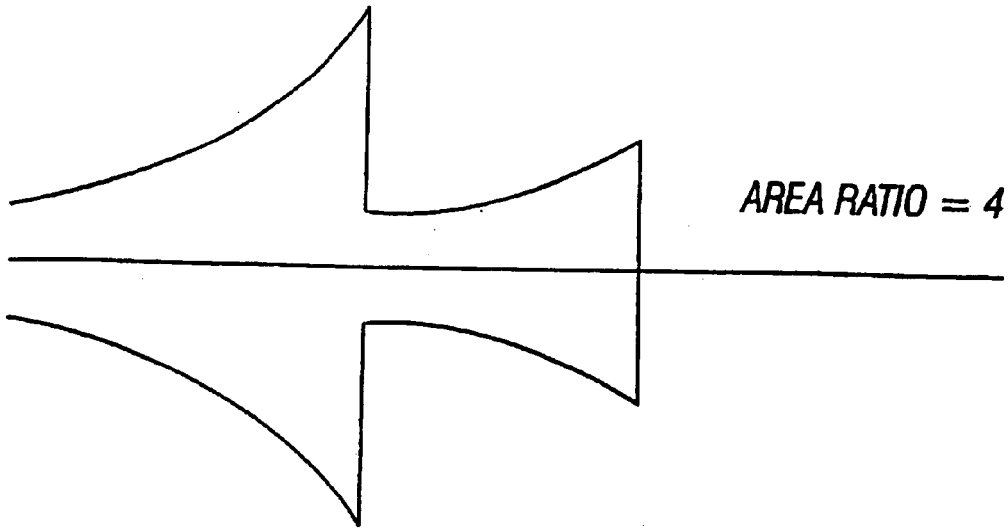
Figure 15B:
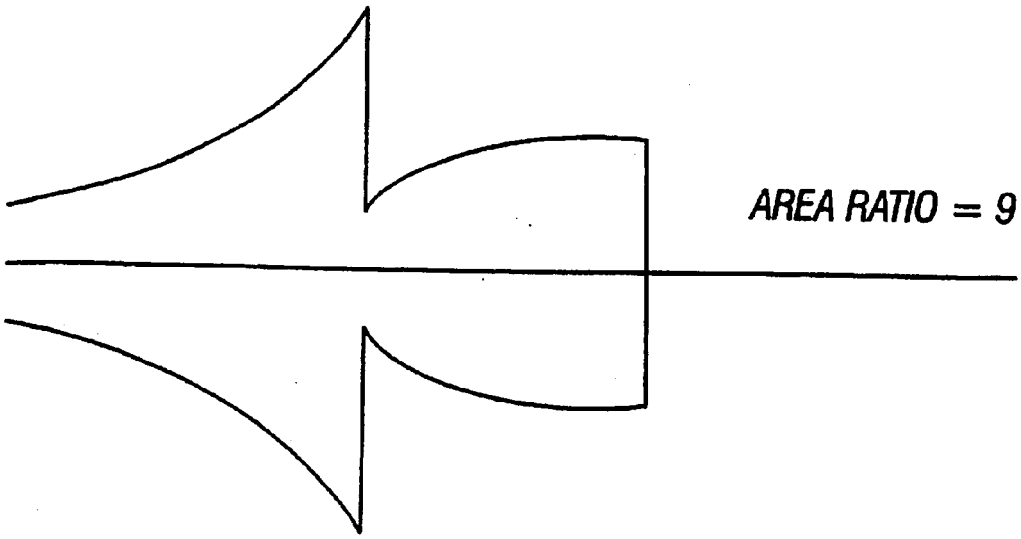

FIGS. 5*b* and 5*c*, 6*b* and 6*c*, and 7*b* are computer simulated curves of acoustic power vs. frequency for the waveguides of FIG. 5*a*, 6*a*, and 7*a* respectively;

FIG. 8 is a computer simulated curve of acoustic power vs. frequency for a waveguide according to FIG. 4, with sixteen sections;

FIG. 9 is a computer simulated curve of acoustic power vs. frequency for a waveguide resulting from the superposition on the waveguide of FIG. 7*a* of a waveguide according to FIG. 4, with sixteen sections;

FIG. 10 is a cross section of a waveguide resulting from the superposition on the waveguide of FIG. 7*a* of a large number of waveguides according to FIG. 4, with a large number of sections;

FIG. 11 is a cross section of a waveguide with standing waves helpful in explaining the length of the sections of waveguides of previous figures;

FIGS. 12*a*, 12*b*, and 12*c*, are cross sections of waveguides illustrating other embodiments of the invention;

FIG. 13 is a cross section of a waveguide combining the embodiments of FIGS. 1 and 4;

FIGS. 14*a*–14*c* are cross sections of similar to the embodiments of FIGS. 5*a*, 6*a*, and 7*a*, combined with the embodiment of FIG. 1; and FIGS. 15*a* and 15*b* are cross sections of waveguides combining the embodiment of FIG. 10 with the embodiment of FIG. 1.

With reference now to the drawings and more particularly to FIG. 1 there is shown a loudspeaker and waveguide assembly according to the invention. A waveguide 14 has a first end or terminus 12 and a second end or terminus 16.

Waveguide 14 is in the form of a hollow tube of narrowing cross sectional area. Walls of waveguide 14 are tapered, such that the cross-sectional area of the waveguide at first end 12 is larger than the cross-sectional area at the second end 16. Second end 16 may be slightly flared for acoustic or cosmetic reasons. The cross section (as taken along line A—A of FIG. 1, perpendicular to the centerline 11 of waveguide 14) may be circular, oval, or a regular or irregular polyhedron, or some other closed contour. Waveguide 14 may be closed ended or open ended. Both ends may radiate into free air as shown or one end may radiate into an acoustic enclosure, such as a closed or ported volume or a tapered or untapered waveguide.

For clarity of explanation, the walls of waveguide 14 are shown as straight and waveguide 14 is shown as uniformly tapered along its entire length. In a practical implementation, the waveguide may be curved to be a desired shape, to fit into an enclosure, or to position one end of the waveguide relative to the other end of the waveguide for acoustical reasons. The cross section of waveguide 14 may be of different geometry, that is, have a different shape or have straight or curved sides, at different points along its length. Additionally, the taper of the waveguide vary along the length of the waveguide.

An electroacoustical transducer 10 is positioned in first end 12 of the waveguide 14. In one embodiment of the invention, electroacoustical transducer 10 is a cone type 65 mm driver with a ceramic magnet motor, but may be another type of cone and magnet transducer or some other sort of electroacoustical transducer. Either side of electroacoustical transducer 10 may be mounted in first end 12 of waveguide 14, or the electroacoustical transducer 10 may be mounted in a wall of waveguide 14 adjacent first end 12 and radiate sound waves into waveguide 14. Additionally, the surface of the electroacoustical transducer 10 that faces away from waveguide 14 may radiate directly to the surrounding environment as shown, or may radiate into an acoustical element such as a tapered or untapered waveguide, or a closed or ported enclosure.

Interior walls of waveguide 14 are essentially lossless acoustically. In the waveguide may be a small amount of acoustically absorbing material 13. The small amount of acoustically absorbing material 13 may be placed near the transducer 10, as described in co-pending U.S. patent application Ser. No. 08/058478, entitled "Frequency Selective Acoustic Waveguide Damping" so that the waveguide is low loss at low frequencies with a relatively smooth response at high frequencies. The small amount of acoustically absorbing material damps undesirable resonances and provides a smoother output over the range of frequencies radiated by the waveguide but does not prevent the formation of low frequency standing waves in the waveguide.

In one embodiment of the invention, the waveguide is a conically tapered waveguide in which the cross-sectional area at points along the waveguide is described by the formula $$B = \frac{x\sqrt{AR}}{\sqrt{AR-1}}$$

$$A(y) = A_{inlet}\left[1 - 2\frac{Y}{B} + \left(\frac{y}{B}\right)^2\right]$$

where A represents the area, where y=the distance measured from the inlet (wide) end, where $$B = \frac{x\sqrt{AR}}{\sqrt{AR-1}},$$

where x=the effective length of the waveguide, and where $$AR = \frac{A_{inlet}}{A_{inlet}}.$$

The first resonance, or tuning frequency of this embodiment is closely approximated as the first non-zero solution of $\alpha f = \tan \beta f$, where $$\alpha = \frac{2\pi\chi}{c_0}\frac{\sqrt{AR}}{\sqrt{AR-1}},$$

$$\beta = \frac{2\pi\chi}{c_0},$$

and $c_0$=the speed of sound. After approximating with the above mentioned formulas, the waveguide may be modified empirically to account for end effects and other factors.

In one embodiment the length x of waveguide 14 is 26 inches. The cross-sectional area at first end 12 is 6.4 square inches and the cross-sectional area at the second end 16 is 0.9 square inches so that the area ratio (defined as the cross-sectional area of the first end 12 divided by the cross-sectional area of the second end 16) is about 7.1.

Figure 2A:
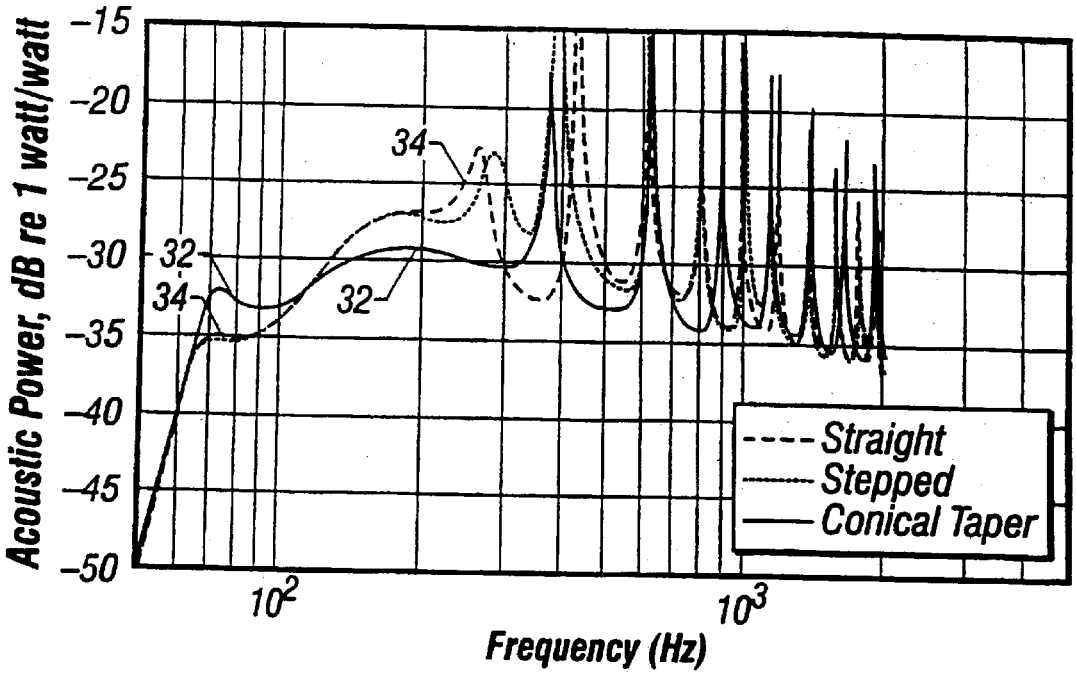
FIG. 2 is a computer simulated curve of acoustic power vs. frequency for a waveguide according to the invention and for a conventional waveguide.
Figure 2B:
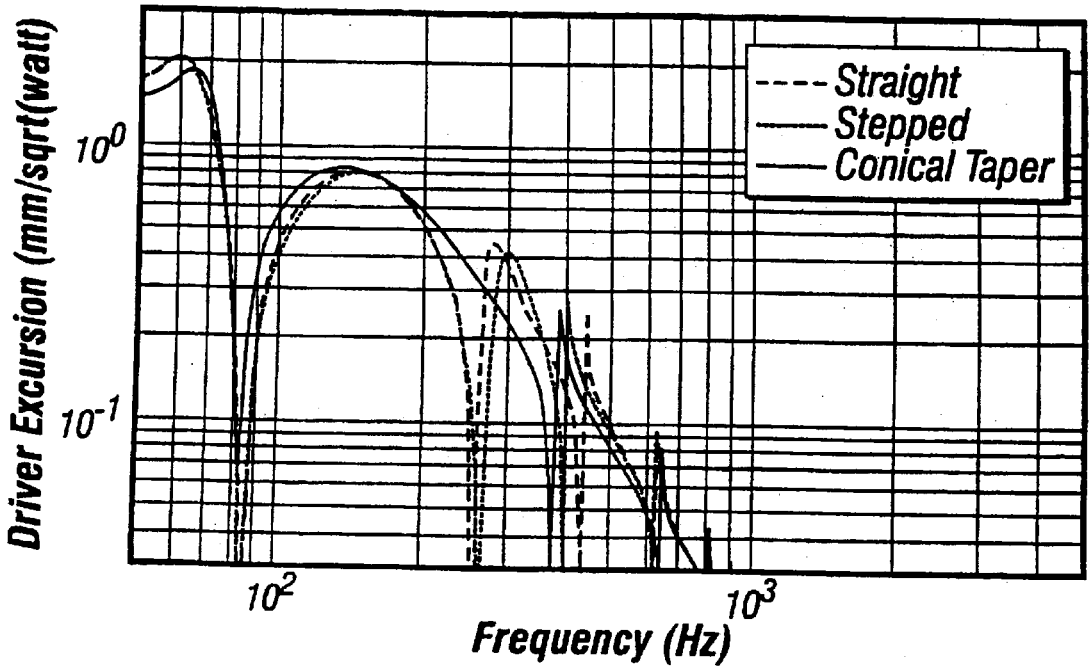

Referring now to FIG. 2, there are shown computer simulated curves of radiated acoustic power vs. frequency for a waveguide loudspeaker system according to the invention (curve 32), without acoustically absorbing material 13 and with a length of 26 inches, and for a straight walled undamped waveguide of similar volume and of a length of 36 inches (curve 34). As can be seen from FIG. 2, the bass range extends to approximately the same frequency (about 70 Hz) and the frequency response for the waveguide system according to the invention is flatter than the untapered waveguide system. Narrowband peaks (hereinafter "spikes") in the two curves can be significantly reduced by the use of acoustically absorbing material (13 of FIG. 1).

Figure 3:
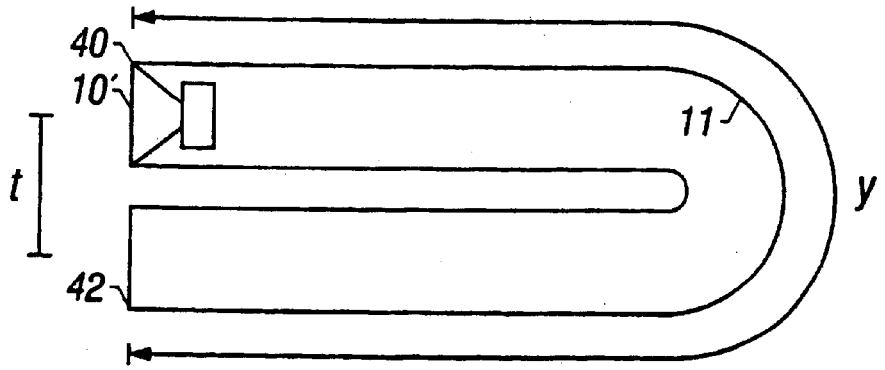
Prior Art FIG. 3
FIG. 3 is a cross-sectional view of a prior art waveguide.

Referring now to FIG. 3, there is shown a prior art loudspeaker and waveguide assembly for the purpose of illustrating a second aspect of the invention. An electroacoustical transducer 10' is positioned in one end 40 of an open ended uniform cross-sectional waveguide 14' which has a length y. The ends of the waveguide are in close proximity to each other (i.e. distance t is small). When transducer 10' radiates a sound wave of a frequency f with wavelength~which is equal to y, the radiation from the waveguide is of inverse phase to the direct radiation from the transducer, and therefore the radiation from the assembly is significantly reduced at that frequency.

Referring now to FIG. 4, there is shown a loudspeaker and waveguide assembly illustrating an aspect of the invention which significantly reduces the waveguide end positioning problem shown in FIG. 3 and described in the accompanying text. An electroacoustical transducer 10 is positioned in an end or terminus 12 of an open-ended waveguide 14*a*. Electroacoustical transducer 10 may be a cone and magnet transducer as shown, or some other sort of electroacoustical transducer, such as electrostatic, piezoelectric or other source of sound pressure waves. Electroacoustical transducer 10 may face either end of waveguide 14*a*, or may be mounted in a wall of waveguide 14*a* and radiate sound waves into waveguide 14*a*. Cavity 17 in which electroacoustical transducer 10 is positioned closely conforms to electroacoustical transducer 10. In this embodiment, interior walls of waveguide 14*a* are acoustically low loss. In waveguide 14*a* may be a small amount of acoustically absorbing material 13, so that the waveguide is low loss acoustically at low frequencies and has a relatively flat response at higher frequencies. The small amount of acoustically absorbing material damps undesirable resonances and provides a smoother output over the range of frequencies radiated by the waveguide but does not prevent the formation of standing waves in the waveguide. Second end, or terminus 16, of waveguide 14*a* radiates sound waves to the surrounding environment. Second end 16 may be flared outwardly for cosmetic or acoustic purposes.

Waveguide 14*a* has a plurality of sections $\mathbf{18}_1$, $\mathbf{18}_2$, . . . $\mathbf{18}_n$ along its length. Each of the sections $\mathbf{18}_1$, $\mathbf{18}_2$, . . . $\mathbf{18}_n$ has a length $x_1$, $X_2$, . . . $x_n$ and a cross-sectional area $A_1$, $A_2$, . . . $A_n$. The determination of length of each of the sections will be described below. Each of the sections may have a different cross-sectional area than the adjacent section. The average cross-sectional area over the length of the waveguide may be determined as disclosed in U.S. Pat. No. 4,628,528, or may be determined empirically. In this implementation, changes 19 in the cross-sectional area are shown as abrupt. In other implementations the changes in cross-sectional area may be gradual.

Referring now to FIG. 5*a*, there is shown a loudspeaker and waveguide assembly according to FIG. 4, with n=4. When the transducer of FIG. 5*a* radiates sound of a frequency f with a corresponding wavelength λ which is equal to x, the radiation from the waveguide is of inverse phase to the radiation from the transducer, but the volume velocity, and hence the amplitude, is significantly different. Therefore, even if waveguide 14*a* is configured such that the ends are in close proximity, as in FIG. 3, the amount of cancellation is significantly reduced.

In one embodiment of an assembly according to FIG. 5*a*, the cross section of the waveguide is round, with dimensions $A_1$ and $A_3$ being 0.53 square inches and $A_2$ and $A_4$ being 0.91 square inches.

In other embodiments of the invention, the product of $A_2$ and $A_4$ is three times the product of $A_1$ and $A_3$, that is $$\frac{((A_2)(A_4))}{((A_1)(A_3))} = 3.$$

The relationships $A_1=A_3=0.86\,\overline{A}$ and $A_2=A_4=1.14\,\overline{A}$, where $\overline{A}$ is the average cross-sectional area of the waveguide, satisfies the relationship.

Figure 5B:
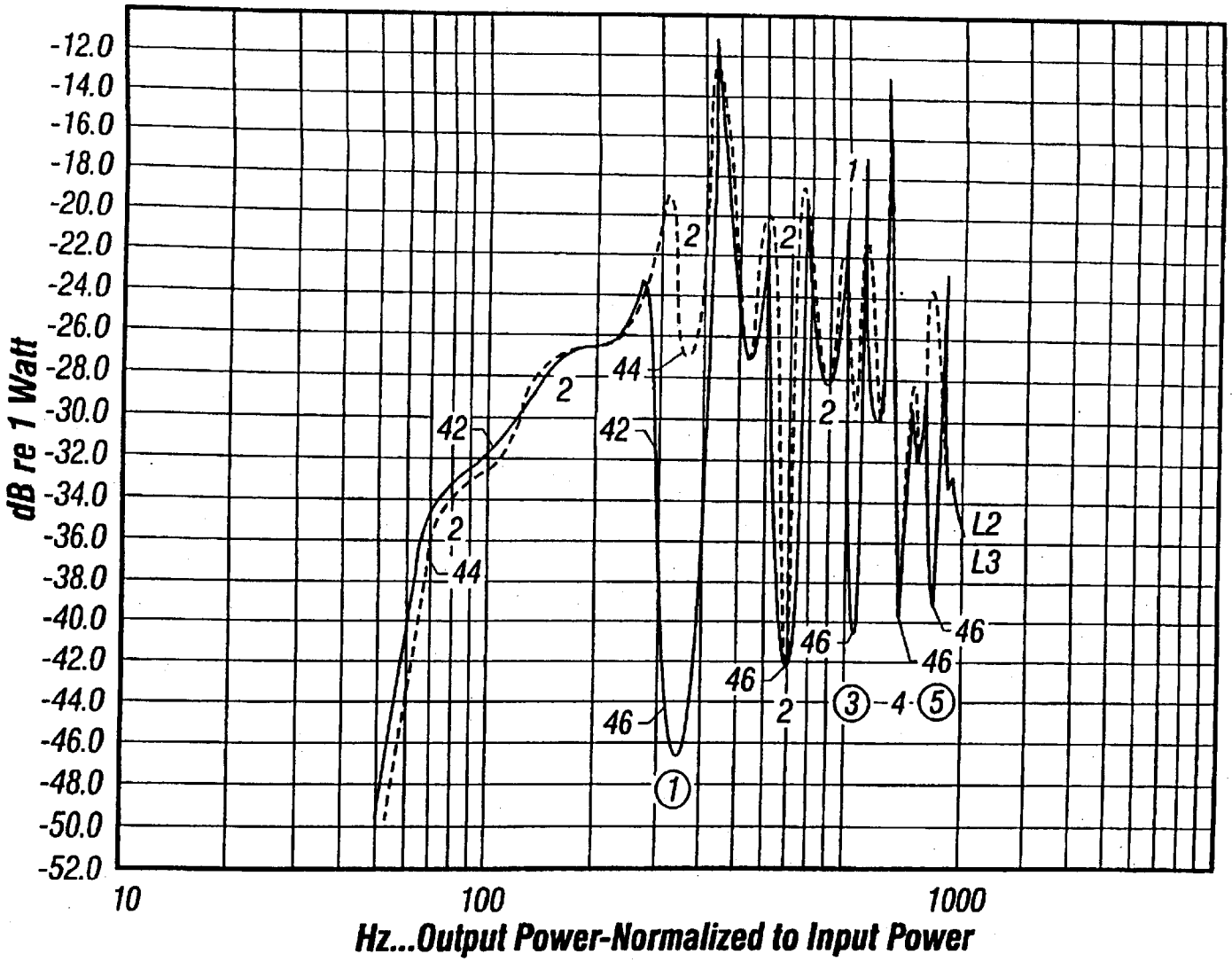
Figure 5C:
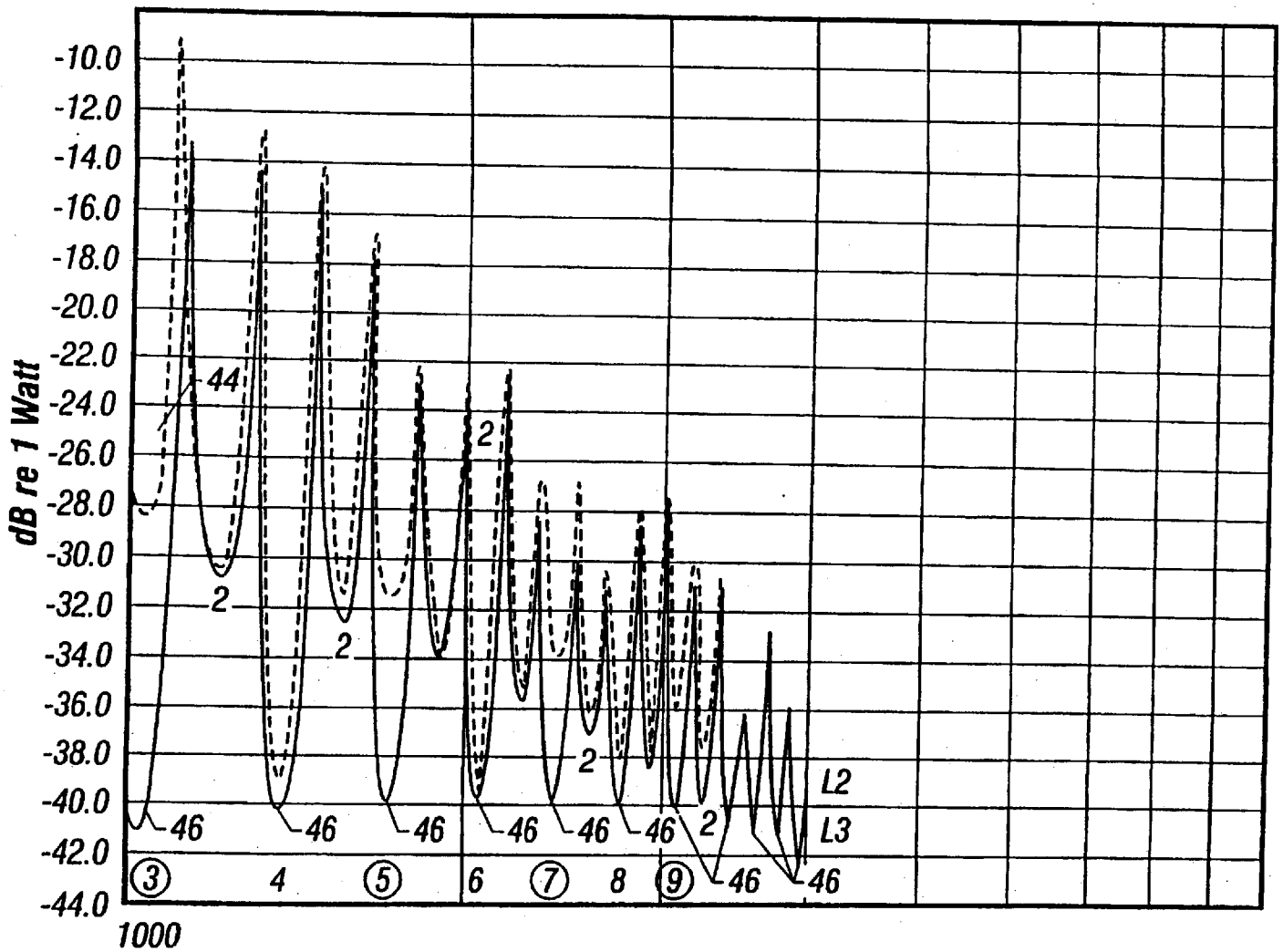

Referring now to FIGS. 5*b* and 5*c*, there are shown two computer simulated curves of output acoustic power vs. frequency for a waveguide system with the ends of the waveguide spaced S cm apart. Curve 42, representing the conventional waveguide as shown in FIG. 3, shows a significant output dip 46 at approximately 350 Hz (hereinafter the cancellation frequency of the waveguide, corresponding to the frequency at which the wavelength is equal to the effective length of the waveguide), and similar dips at integer multiples of the cancellation frequency. Dashed curve 44, representing the waveguide system of FIG. 5*a*, shows that the output dips at about 350 Hz and at the odd multiples of the cancellation frequency have been largely eliminated.

Referring now to FIG. 6*a*, there is shown a loudspeaker and waveguide assembly according to FIG. 4, with n=8. Each section is of length x/8, where x is the total length of the waveguide. In this embodiment, cross-sectional areas $A_1$ . . . $A_8$ satisfy the relationship $$\frac{((A_2)(A_4)(A_6)(A_8))}{((A_1)(A_3)(A_5)(A_7))} = 3.$$

If $A_1$, $A_3$, $A_5$ and $A_7$ are equal and $A_2$ $A_4$ $A_6$ and $A_8$ are equal (as with the embodiment of FIG. 5*a*, this is not necessary for the invention to function), the relationships $A_1=A_3=A_5=A_7=0.73A$ and $A_2=A_4=A_6=A_7=1.27\,\overline{A}$, where $\overline{A}$ is the average cross-sectional area of the waveguide, satisfies the relationship $$\frac{((A_2)(A_4)(A_6)(A_8))}{((A_1)(A_3)(A_5)(A_7))} = 3.$$

Figure 6B:
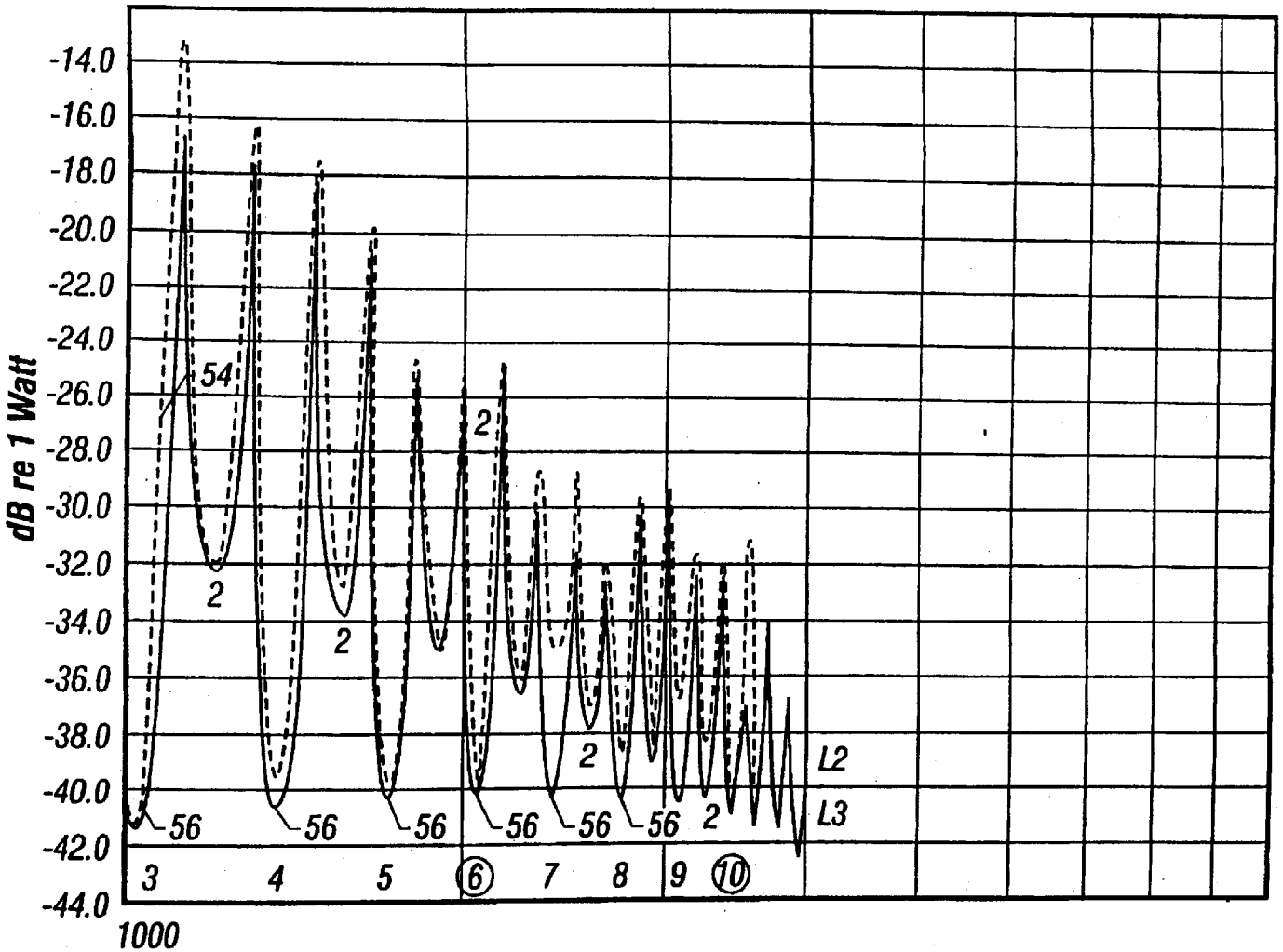
Figure 6C:
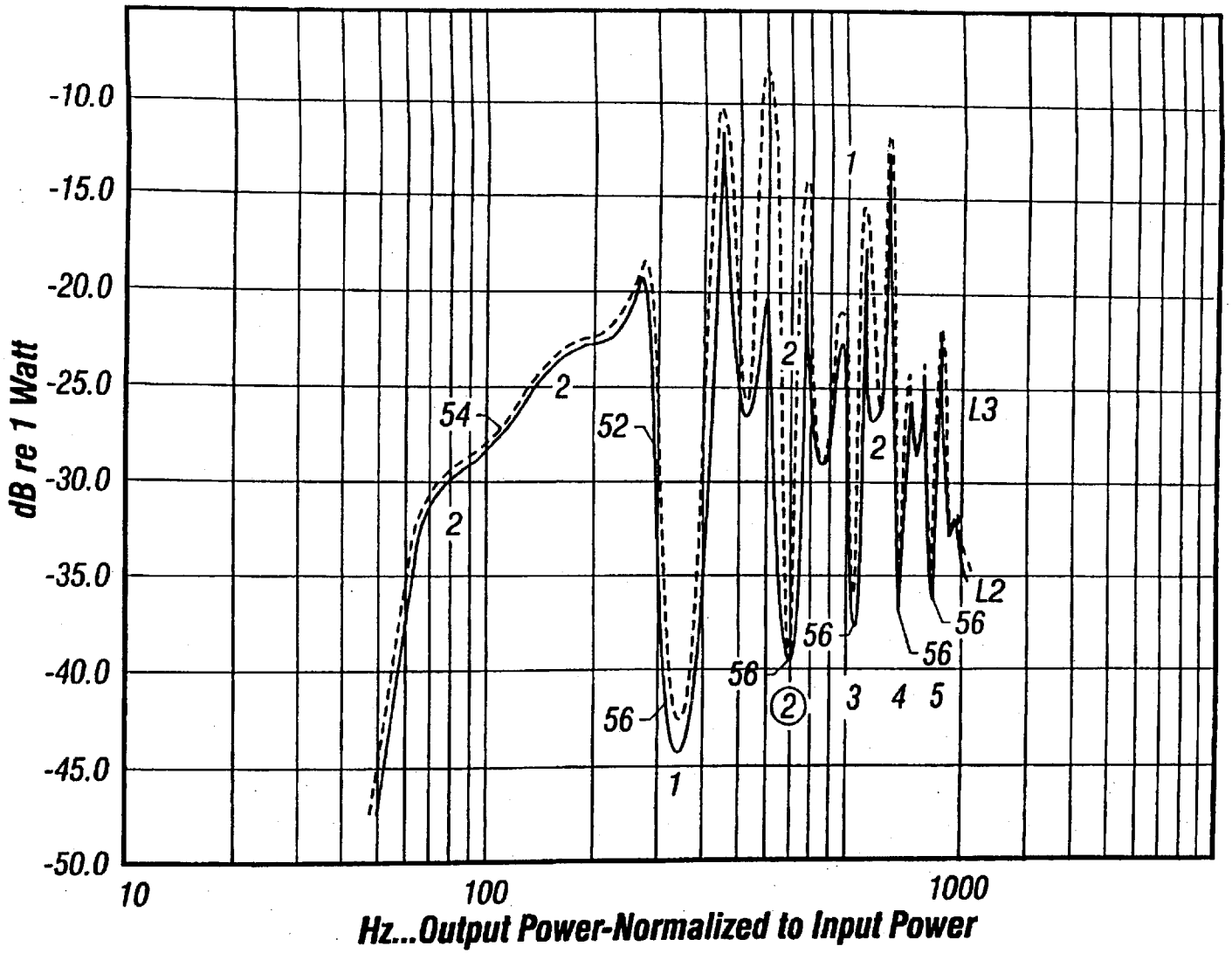

Referring now to FIGS. 6*b* and 6*c*, there are shown two computer simulated curves of output acoustic power vs. frequency for a waveguide with the ends of the waveguide spaced S cm apart. Curve 52, representing a conventional waveguide as shown in FIG. 3, shows a significant output dip 56 at approximately 350-Hz, and similar dips at intogral multiples of about 35 Hz. Dashed curve 54, representing the waveguide of FIG. 6*a*, shows that the output dips at two times the cancellation frequency and at two times the odd multiples of the cancellation frequency (i.e. 2 times 3, 5, 7 . . . =6, 10, 14 . . . ) have been significantly reduced.

Superimposing the waveguide of FIG. 6*a* on the waveguide of FIG. 5*a* yields the waveguide of FIG. 7*a*. In one embodiment of the assembly of FIG. 5*c*, $A_1=A_5=0.63\,\overline{A}$, $A_2=A_6=0.83A$, $A_3=A_7=1.09\,\overline{A}$ and $A_4=A_8=1.44\,\overline{A}$, and the length of each section is x/8.

Figure 7B:
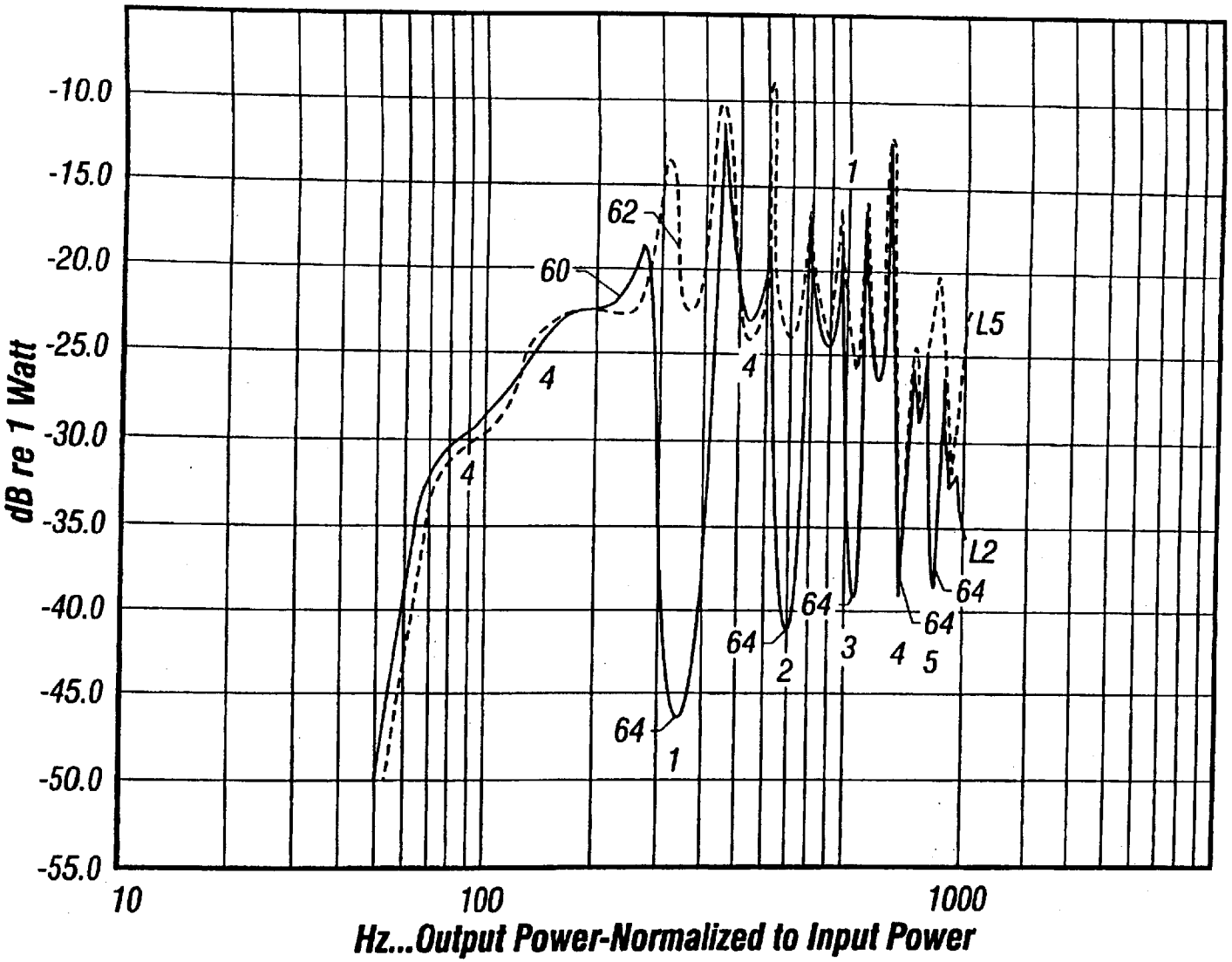

Referring now to FIG. 7*b*, there are shown two computer-simulated curves of output acoustic power vs. frequency for a waveguide with the ends of the waveguide spaced 5 cm apart. Dashed curve 60, representing the conventional waveguide as shown in FIG. 3, shows a significant output dip 64 at about 350 Hz, and similar dips at integer multiples of about 350 Hz. Curve 62, representing the waveguide of FIG. 7*a*, shows that the output dips at the cancellation frequency, at odd multiples (3, 5, 7 . . . ) of the cancellation frequency, and at two times (2, 6, 10, 14 . . . ) the odd multiples of the cancellation frequency have been significantly reduced.

Referring now to FIG. 8, there is shown two computer-simulated curves of output acoustic power vs. frequency for a waveguide with the ends of the waveguide spaced 5 cm apart. Curve 66, representing a conventional waveguide as shown in FIG. 3, shows a significant output dip 70 at about 350 Hz, and similar dips at integer multiples of about 350 Hz. Dashed curve 68, representing a waveguide (not shown) according to FIG. 4, with n=16, with the length of each segment x/16, and with $$\frac{((A_2))(A_4)\ \ldots\ (A_{14})(A_{16}))}{(A_1)(A_3)\ \ldots\ (A_{13})(A_{15}))} = 3$$

shows that the output dips at four times the cancellation frequency and at four times the odd multiples of the cancellation frequency (i.e. 4 times 3, 5, 7 . . . =12, 20, 28 . . . ) have been significantly reduced.

Similarly, output dips at 8, 16, . . . times the odd multiples of the cancellation frequency can be significantly by a waveguide according to FIG. 4 with n=32, 64 . . . , with the length of each section=x/n, and with $$\frac{((A_2)(A_4)\ \ldots\ (A_{n-2})(A_n))}{((A_1)(A_3)\ \ldots\ (A_{n-3})(A_{n-1}))} = 3$$

The waveguides can be superimposed as shown in FIG. 7*a*, to combine the effects of the waveguides.

Referring now to FIG. 9, there is shown two computer-simulated curves of output acoustic power vs. frequency for a waveguide system with the ends of the waveguide spaced 5 cm apart. Curve 71, representing a conventional waveguide system, shows a significant output dip 74 at about 350 Hz, and similar dips at integer multiples of about 350 Hz. Dashed curve 72, representing a waveguide system (not shown) resulting from a superimposition onto the waveguide of FIG. 7*a* of a waveguide according to FIG. 4, with n=16, with the length of each segment x/16, shows that the output dips at the cancellation frequency, the even multiples of the cancellation frequency, at the odd multiples of the cancellation frequency, at two times the odd multiples of the cancellation frequency, and at four times the odd multiples of the cancellation frequency have been significantly reduced.

As n gets large, the superimposed waveguide begins to approach the waveguide shown in FIG. 10. In FIG. 10, the waveguide has two sections of length x/2. The walls of the waveguide are configured such that the cross-sectional area at the beginning of each section is $$\frac{\log_e 3}{2}\bar{A},$$

and increases to $$\frac{3\log_e 3}{2}\bar{A}$$

according to the relationship $$A(y) = \frac{\log_e 3}{2}\bar{A}(3)^{\frac{y}{x}}$$

(where y is distance between transducer end 12 of the waveguide, x is the length of the waveguide, and $\bar{A}$ is the average cross-sectional area of the waveguide).

Referring to FIG. 11, there is shown a waveguide with standing waves helpful in determining the length of the sections. FIG. 11 shows a parallel sided waveguide with a standing wave 80 formed when sound waves are radiated into the waveguide. Standing wave 80 has a tuning frequency f and a corresponding wavelength λ that is equal to the length x of the waveguide. Standing wave 80 represents the pressure at points along the length of waveguide. Pressure standing wave 80 has pressure nulls 82, 84 at the transducer and at the opening of the waveguide, respectively and another null 86 at a point approximately half way between the transducer and the opening. Standing wave 88, formed when sound waves are radiated into the waveguide, represents the volume velocity at points along the length of the waveguide. Volume velocity standing wave 88 has volume velocity nulls 92, 94 between pressure nulls 82 and 86 and between pressure nulls 86 and 84, respectively, approximately equidistant from the pressure nulls. In one embodiment of the invention, a waveguide as shown in FIG. 5*a* (shown in this figure in dotted lines) has four sections, the beginning and the end of the sections is determined by the location of the volume velocity nulls and the pressure nulls of a waveguide with parallel walls and the same average cross-sectional area. First section 18~ ends and second section 182 begins at volume velocity null 92; second section 182 ends and third section 183 begins at pressure null 86; third section 183 ends and fourth section 184 begins at volume velocity null 94. In a straight walled waveguide, the distance between the first pressure null and the first volume velocity null, between the first volume velocity null and the second pressure null, between the second pressure null and that second volume velocity null, and between the second volume velocity null and the third pressure null are all equal, so that the lengths $x_1 \ldots X_4$ of the sections $\mathbf{18}_1 \ldots \mathbf{18}_4$ are all approximately one fourth of the length of the waveguide.

In addition to the standing wave of frequency f and wavelength λ, there may exist in the waveguide standing waves of frequency 2f, 4f, 8f, . . . nf with corresponding wavelengths of λ/2, λ/4, λ/8, . . . λ/n. A standing wave of frequency 2f has five pressure nulls. In a parallel sided waveguide, there will be one pressure null at each end of the waveguide, with the remaining pressure nulls spaced equidistantly along the length of the waveguide. A standing wave of frequency 2f has four volume velocity nulls, between the pressure nulls, and spaced equidistantly between the pressure nulls. Similarly, standing waves of frequencies 4f, 8f, . . . nf with corresponding wavelengths of λ/4, λ/8, . . . λ/n have 2n+1 pressure nulls and 2n volume velocity nulls, spaced similarly to the standing wave of frequency 2f and the wavelength of λ/2. Similar standing waves are formed in waveguides the do not have parallel sides, but the location of the nulls may not be evenly spaced. The location of the nulls may be determined empirically.

Referring to FIGS. 12*a*–12*c*, there are shown other embodiments illustrating other principles of the invention. FIG. 12*a* illustrates the principle that adjacent segments having a length equal to the sections of FIG. 11 may have the same cross-sectional area, and still provide the advantages of the invention. In FIG. 12*a*, the lengths of the segments are determined in the same manner as the sections of FIG. 11. Some adjacent sections have the same cross-sectional areas, and at least one of the segments has a larger cross-sectional area than adjacent segments. The cross-sectional areas may be selected such that $$\frac{((A_2)(A_4))}{((A_1)(A_3))} = 3.$$

A waveguide system according to FIG. 12*a* has advantages similar to the advantages of a waveguide according to FIG. 5*a*. Similarly, waveguides having segments equal to the distance between a pressure null and a volume velocity null of a standing wave with wavelength λ/2, λ/4, λ/8 . . . λ/n with the average cross-sectional areas of the segments conforming to the relationship $$\frac{((A_2)(A_4)\ \ldots\ (A_{n-2})(A_n))}{((A_1)(A_3)\ \ldots\ (A_{n-3})(A_{n-1}))} = 3$$

and with some adjacent segments having equal average cross-sectional areas, has advantages similar to the waveguide system of FIG. 4.

Referring now to FIG. 12*b*, there is illustrated another principle of the invention. In this embodiment, changes 19 in the cross-sectional area do not occur at the points shown in FIG. 11 and described in the accompanying portion of the disclosure. However, if the cross-sectional area of segments $\mathbf{18}_1$, $\mathbf{18}_2$, $\mathbf{18}_3$, and $\mathbf{18}_4$ follow the relationship $$\frac{((A_2)(A_4))}{((A_1)(A_3))} = 3,$$

where A', A2, A3, A4 are the cross-sectional areas of segments $18_1$, $18_2$, $18_3$, and $18_4$, respectively, the cancellation problem described above is significantly reduced.

Referring now to FIG. 12*c*, there is illustrated yet another aspect of the invention. In this embodiment, the cross-sectional area does not change abruptly, but rather changes smoothly according to a sinusoidal or other smooth function. Similar to the embodiment of FIG. 12*b*, however, if the cross-sectional area of segments $18_1$, $18_2$, $18_3$, and $18_4$ follow the relationship $$\frac{((A_2)(A_4))}{((A_1)(A_3))} = 3$$

where $A_1, A_2, A_3, A_4$ are the cross-sectional areas of sections $18_1$, $18_2$, $18_3$, and $18_4$, respectively, the cancellation problem described above is significantly reduced. In the embodiments shown in previous figures and described in corresponding sections of the disclosure, the ratio of the products of the average cross-sectional areas of alternating sections or segments is 3. While a ratio of three provides particularly advantageous results, a waveguide system according to-the invention in which the area ratio is some number greater than one, for example two, shows improved performance.

Referring now to FIG. 13, there is shown an embodiment of the invention that combines the principles of the embodiments of FIGS. 1 and 4. An electroacoustical transducer 10 is positioned in an end of an open-ended waveguide 14'. In one embodiment of the invention, electroacoustical transducer 10 is a cone and magnet transducer or some other electroacoustical transducer, such as electrostatic, piezoelectric or other source of acoustic waves. Electroacoustical transducer 10 may face either end of waveguide 14', or may be mounted in a wall of waveguide 14' and radiate sound waves into waveguide 14'. Cavity 17 in which electroacoustical transducer 10 is positioned closely conforms to electroacoustical transducer 10. Interior walls of waveguide 14' are essentially smooth and acoustically lossless. In waveguide 14' may be a small amount of acoustically absorbing material 13, so that the waveguide is low loss acoustically. The small amount of acoustically absorbing material damps undesirable resonances and provides a smoother output over the range of frequencies radiated by the waveguide system but does not prevent the formation of low frequency standing waves in the waveguide.

Waveguide 14' has a plurality of sections $18_1$, $18_2$, . . . $18_n$ along its length. Each of the sections $18_1$, $18_2$, . . . $18_n$ has a length $x_1$, $x_2$, . . . $x_n$ and a cross-sectional area $A_1$, $A_2$, . . . $A_n$. Each of the sections has a cross-sectional area at end closest to the electroacoustical transducer 10 that is larger than the end farthest from the electroacoustical transducer. In this implementation, changes 19 in the cross-sectional area are shown as abrupt. In an actual implementation, the changes in cross-sectional area may be gradual.

A waveguide according to the embodiment of FIG. 13 combines the advantages of the embodiments of FIGS. 1 and 4. The waveguide end cancellation problem is significantly reduced, and flatter frequency response can be realized with a waveguide system according to FIG. 13 than with a conventional waveguide.

Referring to FIGS. 14*a*–14*c*, there are shown waveguide systems similar to the embodiments of FIGS. 7*a*, 8*a*, and 9*a*, but with narrowing cross-sectional areas toward the right. As with the embodiments of FIGS. 7*a*, 8*a*, and 9*a* end cancellation position problem is significantly reduced; additionally an acoustic performance equivalent to loudspeaker assemblies having longer waveguides can be realized.

A waveguide as shown in FIGS. 14*a*–14*c* has sections beginning and ending at similar places relative to the pressure nulls and volume velocity nulls, but the nulls may not be evenly placed as in the parallel sided waveguide. In waveguides as shown in FIGS. 14*a*–14*c*, the location of the nulls may be determined empirically or by computer modeling. In waveguides as shown in FIG. 14*a*–14*c*, as n becomes large, the waveguide begins to approach the shape of waveguides described by the formula $$A(y) = A_{inlet}\left(1 - \frac{y}{B}\right)^2 SR^{\frac{2y}{x}} \quad \text{for } 0 \le y \le \frac{x}{2}$$

$$A(y) = A_{inlet}\left(1 - \frac{y}{B}\right)^2 \frac{SR^{\frac{2y}{x}}}{SR} \quad \text{for } \frac{x}{2} \le y \le x$$

where:

$$AR = \frac{A_{outlet}}{A_{inlet}}$$

of the unstopped tapered waveguide (i.e. the area ratio)

$SR=2\sqrt{AR}1$ $$B = \frac{x\sqrt{AR}}{\sqrt{AR} - 1}.$$

Examples of such waveguides are shown in FIGS. 15*a* (AR=4) and 15*b* (AR=9). It can be noted that in if the area ratio is 1 (indicating an untapered waveguide) the waveguide is as shown in FIG. 10 and described in the accompanying text.

Other embodiments are within the claims.

What is claimed is:

1. A waveguide system for radiating sound waves, comprising:

a low loss acoustic waveguide having means for supporting standing waves without substantial attenuation for transmitting sound waves, said waveguide comprising a first terminus adapted to be coupled to a source of sound waves;

a second terminus adapted to radiate said sound waves to the external environment;

a centerline running the length of said waveguide;

walls enclosing cross-sectional areas in planes perpendicular to said centerline;

wherein said walls are tapered such that the cross-sectional area at said second terminus is less than the cross-sectional area at said first terminus.

2. A waveguide in accordance with claim 1, wherein said cross-sectional areas progressively decrease as a function of distance from said first terminus.

3. A waveguide system in accordance with claim 1, wherein the cross-sectional area at said second terminus is less than one half the cross-sectional area at said first terminus.

4. A waveguide system in accordance with claim 3, wherein the cross-sectional area at said second terminus is on the order of one seventh of the cross-sectional at said first terminus.

5. A waveguide system for radiating sound waves, comprising:

a low loss acoustic waveguide for transmitting sound waves, said waveguide comprising a first terminus adapted to be coupled to a source of sound waves;

a second terminus adapted to radiate said sound waves to the external environment;

a centerline running the length of said waveguide;

walls enclosing cross-sectional areas in planes perpendicular to said centerline;

wherein said walls are tapered such that the cross-sectional area at said second terminus is less than the cross-sectional area at said first terminus, wherein said cross-sectional areas progressively decrease as a function of distance from said first terminus, wherein said cross-sectional areas vary according to a formula $A(y)=A_{inlet}$ $$\left[1-2\frac{Y}{B}+\left(\frac{y}{B}\right)^2\right],$$

where A is the cross-sectional area, $A_{inlet}$ is the cross-sectional area at said first terminus, y is the distance measured from said first terminus, and $$B=\frac{x\sqrt{AR}}{\sqrt{AR-1}},$$

where x is the length of the waveguide, and AR is the cross-sectional area at said first terminus divided by the cross-sectional area at said second terminus.

6. A waveguide system for radiating sound waves, comprising:

a low loss waveguide having means for supporting standing waves without substantial attenuation for transmitting sound waves, said waveguide comprising a first terminus adapted to be coupled to a source of said sound waves;

a second terminus adapted to radiate said sound waves to the external environment;

a centerline;

walls enclosing cross-sectional areas in planes perpendicular to said centerline;

a plurality of sections, along the length of said centerline, each of said sections having a first end and a second end, said first end nearer said first terminus and said second end nearer said second terminus, each of said sections having an average cross-sectional area;

wherein a first of said plurality of sections and a second of said plurality of sections are constructed and arranged such that there is a mating of said second end of said first section to said first end of said second section; and wherein the cross-sectional area at said second end of said first section has a substantially different cross-sectional area from that at the first end of said second section.

7. A waveguide system in accordance with claim 6, wherein said average crosssectional area of said first section is substantially different from the average crosssectional area of said second section.

8. A waveguide in accordance with claim 7 wherein the cross-sectional area of said second section is substantially constant.

9. A waveguide in accordance with claim 6 wherein the cross-sectional area of said first section is substantially constant.

10. A waveguide system in accordance with claim 6 wherein there are an even number of sections.

11. A waveguide system in accordance with claim 10 wherein a product of the average cross-sectional areas of a first set of alternating sections is approximately three times the product of the average cross-sectional areas of a second set of alternating sections.

12. A waveguide system in accordance with claim 6 wherein said walls are tapered such that the cross-sectional area of said second end of said first section is less than the cross-sectional area of said first end of said first section.

13. A waveguide system in accordance with claim 6 wherein said walls are tapered such that the cross-sectional area of said second end of said second section is less than the cross-sectional area of said first end of said second section.

14. A waveguide system in accordance with claim 6 wherein said walls are tapered such that the cross-sectional area at said second ends of said first section and of the second section are less than the cross-sectional area at said first ends of said first section and of said second section.

15. A waveguide system in accordance with claim 6, wherein said waveguide is constructed and arranged to form a standing pressure wave having a wavelength substantially equal to the effective length l of said low loss waveguide, said standing pressure wave having nulls, and wherein said mating is positioned so that it coincides with one of said pressure nulls.

16. A waveguide system in accordance with claim 6, wherein said waveguide is constructed and arranged to form a standing volume velocity wave having a wavelength substantially equal to the effective length l of said low loss waveguide, said volume velocity standing wave having nulls, and wherein said mating is, positioned so that it coincides with one of said volume velocity nulls.

17. A waveguide system for radiating sound waves, comprising:

a low loss waveguide for transmitting sound waves, said waveguide comprising a first terminus adapted to be coupled to a source of said sound waves;

a second terminus adapted to radiate said sound waves to the external environment;

a centerline;

walls enclosing cross-sectional areas in planes perpendicular to said centerline;

a plurality of sections, along the length of said centerline, each of said sections having a first end and a second end, said first end nearer said first terminus and said second end nearer said second terminus, each of said sections having an average crosssectional area;

wherein a first of said plurality of sections and a second of said plurality of sections are constructed and arranged such that there is a mating of said second end of said first section to said first end of said second section; and wherein the cross-sectional area at said second end of said first section has a substantially different cross-sectional area from that at the first end of said second section, wherein said waveguide is constructed and arranged to form a standing pressure wave having a wavelength substantially equal to the effective length I of said low loss waveguide, said standing pressure wave having nulls, and wherein said mating is positioned so that it coincides with one of said pressure nulls, wherein said wavelength is substantially equal to $$A(y) = A_{inlet}\left[1 - 2\frac{Y}{B} + \left(\frac{Y}{B}\right)^2\right]$$

where n is an integer greater than one.

18. A waveguide system for radiating sound waves, comprising:

a low loss waveguide for transmitting sound waves, said waveguide comprising a first terminus adapted to be coupled to a source of said sound waves;

a second terminus adapted to radiate said sound waves to the external environment;

a centerline;

walls enclosing cross-sectional areas in planes perpendicular to said centerline;

a plurality of sections, along the length of said centerline, each of said sections having a first end and a second end, said first end nearer said first terminus and said second end nearer said second terminus, each of said sections having an average crosssectional area;

wherein a first of said plurality of sections and a second of said plurality of sections are constructed and arranged such that there is a mating of said second end of said first section to said first end of said second section; and wherein the cross-sectional area at said second end of said first section has a substantially different cross-sectional area from that at the first end of said second section, wherein said waveguide is constructed and arranged to form a standing volume velocity wave having a wavelength substantially equal to the effective length l of said low loss waveguide, said volume velocity standing wave having nulls, and wherein said mating is positioned so that it coincides with one of said volume velocity nulls, wherein said wavelength is substantially equal to $$A(y) = A_{inlet}\left[1 - 2\frac{Y}{B} + \left(\frac{Y}{B}\right)^2\right]$$

where n is an integer greater than one.

19. A waveguide system, for radiating sound waves, comprising:

a low loss waveguide for transmitting sound waves, said waveguide comprising a first terminus adapted to be coupled to a source of said sound waves;

a second terminus adapted to radiate said sound waves to the external environment;

a centerline;

walls enclosing cross-sectional areas in planes perpendicular to said centerline;

a plurality of sections, along the length of said centerline, each of said sections having a first end and a second end, said first end nearer said first terminus and said second end nearer said second terminus, each of said sections having an average crosssectional area;

wherein a first of said plurality of sections and a second of said plurality of sections are constructed and arranged such that there is a mating of said second end of said first section to said first end of said second section; and wherein the cross-sectional area at said second end of said first section has a substantially different cross-sectional area from that at the first end of said second section, wherein said waveguide has a resonant frequency, said frequency having an associated wave length λ, and wherein the length of each of said plurality of sections is approximately equal to $$A(y) = A_{inlet}\left[1 - 2\frac{Y}{B} + \left(\frac{Y}{B}\right)^2\right]$$

where n is an integer.

20. A waveguide system for radiating sound waves, comprising:

a low loss waveguide having means for supporting standing waves without substantial attenuation for transmitting sound waves, said waveguide comprising a first terminus adapted to be coupled to a source of said sound waves;

a second terminus adapted to radiate said sound waves to the external environment;

a centerline, running the length of said waveguide;

walls enclosing cross-sectional areas in planes perpendicular to said centerline;

a plurality of sections, along the length of said centerline, each of said sections having a first end and a second end, said first end nearer said first terminus and said second end nearer said second terminus;

wherein a first of said plurality of sections and a second of said plurality of sections are constructed and arranged such that there is a mating of said second end of said first section to said first end of said second section;

wherein the cross-sectional area of said first section increases from said first end to said second end according to a first exponential function and wherein the cross-sectional area at said second end of said first section is larger than the cross-sectional area at said first end of said second section.

21. A waveguide system in accordance with claim 20, wherein said crosssectional area of said second section increases from said first end to said second end t according to a first exponential function.

22. A waveguide system in accordance with claim 20, wherein said crosssectional area of said second section increases from said first end to said second end according to a second exponential function.

23. A waveguide system or radiating sound waves, comprising: a low loss waveguide having means for supporting standing waves without substantial attenuation for transmitting sound waves having a tuning frequency, said frequency having a corresponding wavelength, said waveguide comprising a centerline, running the length of said waveguide;

walls enclosing cross-sectional areas in planes perpendicular to said centerline;

a plurality of sections, along said centerline, each of said sections having a length of approximately one fourth of said wavelength, each of said sections having an average cross-sectional area;

wherein the average cross-sectional area of a first of said plurality of sections is different from the average cross-sectional area of an adjacent one of said plurality of sections.

24. A waveguide system in accordance with claim 23 wherein the cross-sectional area of said first section is substantially constant.

25. A waveguide system in accordance with claim 24 wherein the cross-sectional area of said adjacent section is substantially constant.

26. A waveguide system in accordance with claim 23 wherein a product of said average cross-sectional areas of a first set of alternating sections is approximately three times a product of said average cross-sectional areas of a second set of alternating sections.

27. A waveguide system for radiating sound waves, said waveguide having segments of length approximately equal to $$A(y) = A_{inlet}\left[1 - 2\frac{Y}{B} + \left(\frac{Y}{B}\right)^2\right]$$

where l is the effective length of said waveguide and n is a positive integer, each of said segments having an average cross-sectional area, wherein a product of the average cross-sectional areas of a first set of alternating segments is greater than two times a product of the average cross-sectional areas of a second set of alternating segments.

28. A waveguide system in accordance with claim 27 wherein said product of said average cross-sectional areas of said first set of alternating segments is approximately three times said average cross-sectional area of said second set of alternating segments.

29. A waveguide m accordance with claim 27, wherein one of said segments has an average cross-sectional area greater than the cross-sectional area of either of the adjacent segments.

30. A waveguide for radiating sound waves, constructed and arranged to form standing pressure waves and standing volume velocity waves, said volume velocity standing wave having a wavelength substantially equal to the effective length I of said waveguide, said volume velocity standing wave having volume velocity nulls;

said pressure standing wave having a wavelength substantially equal to the effective length l of said waveguide, said pressure standing wave having pressure nulls, said pressure nulls occurring between said volume velocity nulls;

said volume velocity nulls and said pressure nulls delimiting a plurality of segments of said waveguide, each of said segments having an average cross-sectional area; and wherein a product of the average cross-sectional areas of a first set of alternating segments is greater than two times a product of the average cross-sectional areas of a second set of alternating segments.

31. A waveguide in accordance with claim 30 wherein said product of said average cross-sectional areas of said first set of alternating segments is approximately three times said average cross-sectional area of said second set of alternating segments.

32. A waveguide in accordance with claim 30, wherein one of said segments has an average cross-sectional area greater than either of the adjacent segments.

* * * * *